US005870956A

United States Patent [19]

Ghosh et al.

[11] Patent Number: 5,870,956

[45] **Date of Patent: *Feb. 16, 1999**

[54] ZIRCONIA CERAMIC LITHOGRAPHIC PRINTING PLATE

[75] Inventors: Syamal Kumar Ghosh; Dilip Kumar Chatterjee, both of Rochester; Donald Michael Korn, Penfield; Nicoletta Assaro Zongrone; Mark Anthony Harris, both of Rochester, all of N.Y.

[73] Assignee: Eastman Kodak Company, Rochester, N.Y.

[ * ] Notice: The term of this patent shall not extend beyond the expiration date of Pat. No. 5,839,370.

[21] Appl. No.: 898,944

[22] Filed: Jul. 23, 1997

Related U.S. Application Data

[62] Division of Ser. No. 576,178, Dec. 21, 1995, Pat. No. 5,743,188.

[51] Int. Cl.[6] ..... B41N 1/14

[52] U.S. Cl. ..... 101/453; 101/456; 101/478; 430/302

[58] Field of Search ..... 101/453, 454, 101/456, 458, 459, 467, 478; 430/302

[56] References Cited

U.S. PATENT DOCUMENTS

| | | | |
|---|---|---|---|
| 3,506,779 | 4/1970 | Brown et al. | 101/467 |
| 3,549,733 | 12/1970 | Caddell | 101/401.1 |
| 3,574,657 | 4/1971 | Burnett | 101/465 |
| 3,654,864 | 4/1972 | Ovshinsky | 101/467 |
| 3,793,033 | 2/1974 | Mukherjee | 101/456 |
| 3,832,948 | 9/1974 | Barker | 101/401.1 |
| 3,945,318 | 3/1976 | Landsman | 101/467 |
| 3,962,318 | 6/1976 | Eames . | |
| 3,962,513 | 6/1976 | Eames | 101/463.1 |
| 3,964,389 | 6/1976 | Peterson | 101/467 |
| 4,034,183 | 7/1977 | Uhlig | 219/121.85 |
| 4,054,094 | 10/1977 | Caddell | 101/467 |
| 4,081,572 | 3/1978 | Pacansky | 101/467 |
| 4,334,006 | 6/1982 | Kitajima et al. | 430/254 |
| 4,687,729 | 8/1987 | Cadwell et al. | 101/463.1 |
| 4,693,958 | 9/1987 | Schwartz | 430/302 |
| 4,731,317 | 3/1988 | Fromson | 430/159 |
| 4,794,680 | 1/1989 | Meyerhoff et al. | 492/54 |
| 5,045,697 | 9/1991 | Schneider | 347/224 |
| 5,238,778 | 8/1993 | Hirai | 101/467 |
| 5,290,332 | 3/1994 | Chatterjee et al. | 501/103 |
| 5,293,817 | 3/1994 | Nussel et al. | 101/453 |
| 5,317,970 | 6/1994 | Nussel et al. | 101/478 |
| 5,336,282 | 8/1994 | Ghosh et al. | 501/103 |
| 5,345,869 | 9/1994 | Treverton et al. | 101/454 |
| 5,353,705 | 10/1994 | Lewis | 101/453 |
| 5,358,913 | 10/1994 | Chatterjee et al. | 501/103 |
| 5,385,092 | 1/1995 | Lewis | 101/467 |
| 5,395,729 | 3/1995 | Reardon | 430/200 |
| 5,543,269 | 8/1996 | Chatterjee et al. | 430/346 |

FOREIGN PATENT DOCUMENTS

| | | |
|---|---|---|
| 0 001 068 | 3/1979 | European Pat. Off. . |
| 0 531 878 | 3/1993 | European Pat. Off. . |
| 0 573 091 | 12/1993 | European Pat. Off. . |
| 4 442 235 | 12/1993 | Germany . |

*Primary Examiner*—Stephen R. Funk
*Attorney, Agent, or Firm*—J. Lanny Tucker

[57] ABSTRACT

Lithographic printing is carried out by a novel process utilizing a zirconia ceramic as a printing plate. In this process, the surface of the zirconia ceramic printing plate is imagewise exposed to radiation which transforms it from a hydrophilic to an oleophilic state or from an oleophilic to a hydrophilic state, thereby creating a lithographic printing surface which is hydrophilic in non-image areas and is oleophilic and thus capable of accepting printing ink in image areas. The zirconia ceramic printing plate utilized in this process is capable of extremely long printing runs, is especially well adapted for direct digital laser imaging using images that are electronically captured and digitally stored, and can be reused by erasing the image from the ceramic surface by thermally-activated oxidation or laser-assisted oxidation.

12 Claims, No Drawings

ZIRCONIA CERAMIC LITHOGRAPHIC PRINTING PLATE

This application is a division of Ser. No. 576,178 filed Dec. 12, 1995 now U.S. Pat. No. 5,743,188.

CROSS-REFERENCE TO RELATED APPLICATIONS

U.S.-A-5,543,269 (chatterjee et. al.) describes a method of imaging by focusing a laser beam on the surface of a doped zirconium oxide ceramic for a time sufficient to change the contrast and thereby produce an image.

FIELD OF THE INVENTION

This invention relates in general to lithography and in particular to a new and improved method of lithographic printing. More specifically, this invention relates to a novel method of lithographic printing which does not require development of the imagewise-exposed lithographic printing plate.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described, for example, in U. S. Pat. Nos. 3,755,116, 3,887,447, 3,935,080, 4,087,341, 4,201,836, 4,272,342, 4,294,672, 4,301,229, 4,396,468, 4,427,500, 4,468,295, 4,476,006, 4,482,434, 4,545,875, 4,548,683, 4,564,429, 4,581,996, 4,618,405, 4,735,696, 4,897,168 and 4,919,774.

In the manufacture of lithographic printing plates, the graining process is typically followed by an anodizing process, utilizing an acid such as sulfuric or phosphoric acid, and the anodizing process is typically followed by a process which renders the surface hydrophilic such as a process of thermal silication or electrosilication. The anodization step serves to provide an anodic oxide layer and is preferably controlled to create a layer of at least 0.3 g/m$^2$. Processes for anodizing aluminum to form an anodic oxide coating and then hydrophilizing the anodized surface by techniques such as silication are very well known in the art, and need not be further described herein.

Included among the many patents relating to processes for anodization of lithographic printing plates are U.S. Pat. Nos. 2,594,289, 2,703,781, 3,227,639, 3,511,661, 3,804,731, 3,915,811, 3,988,217, 4,022,670, 4,115,211, 4,229,266 and 4,647,346. Illustrative of the many materials useful in forming hydrophilic barrier layers are polyvinyl phosphonic acid, polyacrylic acid, polyacrylamide, silicates, zirconates and titanates. Included among the many patents relating to hydrophilic barrier layers utilized in lithographic printing plates are U.S. Pat. Nos. 2,714,066, 3,181,461, 3,220,832, 3,265,504, 3,276,868, 3,549,365, 4,090,880, 4,153,461, 4,376,914, 4,383,987, 4,399,021, 4,427,765, 4,427,766, 4,448,647, 4,452,674, 4,458,005, 4,492,616, 4,578,156, 4,689,272, 4,935,332 and European Patent No. 190,643.

The result of subjecting aluminum to an anodization process is to form an oxide layer which is porous. Pore size can vary widely, depending on the conditions used in the anodization process, but is typically in the range of from about 0.1 to about 10 micrometers. The use of a hydrophilic barrier layer is optional but preferred. Whether or not a barrier layer is employed, the aluminum support is characterized by having a porous wear-resistant hydrophilic surface which specifically adapts it for use in lithographic printing, particularly in situations where long press runs are required.

A wide variety of radiation-sensitive materials suitable for forming images for use in the lithographic printing process are known. Any radiation-sensitive layer is suitable which, after exposure and any necessary developing and/or fixing, provides an area in imagewise distribution which can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate which does not require development with an alkaline developing solution. Examples of the many patents and published patent applications relating to such prior efforts include:

(1) Brown et al, U.S. Pat. No. 3,506,779, issued Apr. 14, 1970.

This patent describes a process in which a printing plate blank is imagewise exposed with a laser beam which is intensity modulated and deflected in accordance with control signals. The exposed areas are vaporized, thereby forming ink transferring recesses for intaglio printing or leaving raised ink transferring surfaces for letter press printing, or chemically altered to facilitate further processing.

(2) Caddell, U.S. Pat. No. 3,549,733, issued Dec. 22, 1970.

This patent describes a method for producing a printing plate in which a polymeric surface layer is subjected to a controlled laser beam of sufficient intensity to decompose the layer and form depressions in the surface of the plate.

(3) Burnett, U.S. Pat. No. 3,574,657, issued Apr. 13, 1971.

This patent describes a method for producing a printing plate in which an image is formed by exposing a cured allylic resin coating to a heat pattern.

(4) Mukherjee, U.S. Pat. No. 3,793,033, issued Feb, 19, 1974.

This patent describes a lithographic printing plate comprising a support and a hydrophilic imaging layer comprising a phenolic resin, an hydroxyethylcellulose ether and a photoinitiator. Upon imagewise exposure, the imaging layer becomes oleophilic in the exposed areas while remaining hydrophilic in the unexposed areas and thus can be used on a lithographic printing press, utilizing conventional inks and fountain solutions, without the need for a development step and consequently without the need for a developing solution.

(5) Barker, U.S. Pat. No. 3,832,948, issued Sep. 3, 1974.

This patent describes a method for producing a printing plate in which a surface in relief is formed by scanning coherent radiation over the surface of a radiation-absorptive thin film supported by a plastic substrate.

(6) Landsman, U.S. Pat. No. 3,945,318, issued Mar. 23, 1976.

This patent describes a method in which a lithographic printing plate blank is processed by applying a beam of laser radiation through a radiation transparent sheet to transfer selected portions on the sheet onto a lithographic surface.

(7) Eames, U.S. Pat. No. 3,962,513, issued Jun. 8, 1976.

This patent describes a method for producing a printing plate in which a transfer film comprising a transparent substrate, a layer comprising particles which absorb laser energy, and a layer of ink receptive resin is exposed with a laser beam to effect transfer to a lithographic surface.

(8) Peterson, U.S. Pat. No. 3,964,389, issued Jun. 22, 1976.

This patent describes a method for producing a printing plate in which a transfer film comprising a transparent substrate and a layer comprising particles which absorb laser energy is exposed with a laser beam to effect transfer to a lithographic surface.

(9) Uhlig, U.S. Pat. No. 4,034,183, issued Jul. 5, 1977.

This patent describes a lithographic printing plate comprising a support and a hydrophilic imaging layer that is imagewise exposed with laser radiation to render the exposed areas oleophilic and thereby form a lithographic printing surface. The printing plate can be used on a lithographic printing press employing conventional inks and fountain solutions without the need for a development step. If the hydrophilic imaging layer is water-insoluble, the unexposed areas of the layer serve as the image background. If the hydrophilic imaging layer is water-soluble the support which is used must be hydrophilic and then the imaging layer is removed in the unexposed areas by the fountain solution to reveal the underlying hydrophilic support.

(10) Caddell et al, U.S. Pat. No. 4,054,094, issued Oct. 18, 1977.

This patent describes a lithographic printing plate comprised of a support, a polymeric layer on the support, and a thin top coating of a hard hydrophilic material on the polymeric layer. A laser beam is used to etch the surface of the plate, thereby rendering it capable of accepting ink in the etched regions and accepting water in the unetched regions.

(11) Pacansky, U.S. Pat. No. 4,081,572, issued Mar. 28, 1978.

This patent describes printing plates comprising a substrate and a coating of a hydrophilic polymer containing carboxylic acid functionality which can be selectively imagewise converted to a hydrophobic condition by heat.

(12) Kitajima et al, U.S. Pat. No. 4,334,006, issued Jun. 8, 1982.

This patent describes a method for forming an image in which a photosensitive material composed of a support and a layer of a photosensitive composition is exposed and developed by heating in intimate contact with a peeling development carrier sheet and subsequently peeling the carrier sheet from the photosensitive material.

(13) Schwartz et al, U.S. Pat. No. 4,693,958, issued Sep. 15, 1987.

This patent describes a lithographic printing plate comprising a support and a hydrophilic water-soluble heat-curable imaging layer which is imagewise exposed by suitable means, such as the beam of an infrared laser, to cure it and render it oleophilic in the exposed areas. The uncured portions of the imaging layer can then be removed by merely flushing with water.

(14) Fromson et al, U.S. Pat. No. 4,731,317, issued Mar. 15, 1988.

This patent describes a lithographic printing plate comprising a grained and anodized aluminum substrate having thereon a coating comprising a diazo resin in admixture with particulate energy-absorbing material that will absorb incident radiation and reradiate it as radiation that will change the diazo resin coating.

(15) Hirai et al, U.S. Pat. No. 5,238,778, issued Aug. 24, 1993.

This patent describes a method of preparing a lithographic printing plate utilizing an element comprising a support having thereon a heat transfer layer containing a colorant, a heat-fusible substance and a photo-curable composition. Heat is applied in an image pattern to transfer the image onto a recording material having a hydrophilic surface and the transferred image is exposed to actinic radiation to cure it.

(16) Lewis et al, U.S. Pat. No. 5,353,705, issued Oct. 11, 1994.

This patent describes lithographic printing plates, suitable for imaging by means of laser devices which ablate one or more layers, which include a secondary ablation layer that ablates only partially as a result of destruction of overlying layers.

(17) Lewis et al, U.S. Pat. No. 5,385,092, issued Jan. 31, 1994.

This patent describes lithographic printing plates intended to be imaged by means of laser devices that emit in the infrared region. Both wet plates that utilize fountain solution during printing and dry plates to which ink is applied directly are described. Laser output either ablates one or more layers or physically transforms a surface layer whereby exposed areas exhibit an affinity for ink or an ink-abhesive fluid, such as fountain solution, that differs from that of unexposed areas.

(18) Reardon et al, U.S. Pat. No. 5,395,729, issued Mar. 7, 1995.

This patent describes a laser-induced thermal transfer process useful in applications such as color proofing and lithography. In this process, an assemblage comprising a donor element and a receiver element is imagewise exposed to laser radiation, the donor element is separated from the receiver element, and the receiver element is subjected to a post-transfer treatment to substantially eliminate back-transfer.

(19) European Patent Application No. 0 001 068, published Mar. 21, 1979.

This patent application describes a process for preparing a lithographic printing plate by providing an aluminum substrate having a hydrophilic porous anodic oxide layer thereon and depositing an oleophilic image in and on the porous layer by sublimation.

(20) European Patent Application No. 0 573 091, published Dec. 8, 1993.

This patent application describes a lithographic printing plate comprising a support having an oleophilic surface, a recording layer that is capable of converting laser beam radiation into heat, and an oleophobic surface layer. The recording layer and the oleophobic surface layer can be the same layer or separate layers. The printing plate is imagewise exposed with a laser beam and is then rubbed to remove the oleophobic surface layer in the exposed areas so as to reveal the underlying oleophilic surface and thereby form a lithographic printing surface.

Lithographic printing plates designed to eliminate the need for a developing solution which have been proposed heretofore have suffered from one or more disadvantages which have limited their usefulness. For example, they have lacked a sufficient degree of discrimination between oleophilic image areas and hydrophilic non-image areas with the result that image quality on printing is poor, or they have had oleophilic image areas which are not sufficiently durable to permit long printing runs, or they have had hydrophilic non-image areas that are easily scratched and worn, or they have been unduly complex and costly by virtue of the need to coat multiple layers on the support.

The lithographic printing plates described hereinabove are printing plates which are employed in a process which employs both a printing ink and an aqueous fountain solution. Also well known in the lithographic printing art are so-called"waterless" printing plates which do not require the use of a fountain solution. Such plates have a lithographic printing surface comprised of oleophilic (ink-accepting) image areas and oleophobic (ink-repellent) background areas. They are typically comprised of a support, such as aluminum, a photosensitive layer which overlies the support, and an oleophobic silicone rubber layer which overlies the photosensitive layer, and are subjected to the steps of imagewise exposure followed by development to form the lithographic printing surface.

It is toward the objective of providing an improved method of lithographic printing that requires no alkaline developing solution, that is simple and inexpensive, and which overcomes many of the limitations and disadvantages of the prior art that the present invention is directed.

SUMMARY OF THE INVENTION

In accordance with this invention, a new and improved method of lithographic printing is provided which is based on the use of a zirconia ceramic to form a lithographic printing surface. The method of this invention comprises the steps of:

(1) providing a lithographic printing plate having a zirconia ceramic surface;

(2) imagewise exposing the zirconia ceramic surface to electromagnetic radiation which transforms it from a hydrophilic to an oleophilic state or from an oleophilic to a hydrophilic state, thereby creating a lithographic printing surface which is hydrophilic in the non-image areas and is oleophilic and thus capable of accepting printing ink in the image areas;

(3) contacting the lithographic printing surface with an aqueous fountain solution and with a lithographic printing ink, whereby the non-image areas retain the fountain solution and repel the ink and the image areas accept the ink and repel the fountain solution to thereby form an inked lithographic printing surface; and (4) contacting the inked lithographic printing surface with a substrate to thereby transfer the ink to the substrate and form an image thereon.

The method of this invention has many advantages in comparison with previously known lithographic printing processes. Thus, for example, no chemical processing of the printing plate is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the plate can be carried out with a focused laser beam which converts the ceramic surface from a hydrophilic to an oleophilic state or from an oleophilic to a hydrophilic state. Exposure with a laser beam enables the plate to be prepared directly from digital data without the need for intermediate films and conventional time-consuming optical printing methods. Since no chemical processing, wiping, brushing, baking or treatment of any kind is required, it is feasible to expose the printing plate directly on the printing press by equipping the press with a laser exposing device and suitable means for controlling the position of the laser exposing device. A still further advantage is that the plate is well adapted to function with conventional fountain solutions and conventional lithographic printing inks so that no novel or costly chemical compositions are required.

The zirconia ceramic utilized in this invention has many characteristics which render it especially beneficial for use in lithographic printing. Thus, for example, the ceramic surface is extremely durable, abrasion-resistant, and long wearing. Lithographic printing plates utilizing this surface are capable of producing a virtually unlimited number of copies, for example, press runs of up to several million. On the other hand, since very little effort is required to prepare the plate for printing, it is also well suited for use in very short press runs. Discrimination between oleophilic image areas and hydrophilic non-image areas is excellent so that image quality on printing is unsurpassed. The printing plate can be produced in rigid, semi-rigid or flexible forms, as desired. The imaging process is fast and easy to perform, image resolution is very high and the process is especially well suited to images that are electronically captured and digitally stored.

The lithographic printing plates utilized in this invention exhibit exceptional long-wearing characteristics that greatly exceed those of the conventional grained and anodized aluminum plates whose manufacture is hereinabove described. Moreover, they are much simpler and less costly than conventional waterless plates that are based on the use of silicone rubbers, while also providing for greater run lengths than can be achieved with such waterless plates.

A further particular advantage of lithographic printing plates prepared from zirconia ceramics as described herein is that, unlike conventional lithographic printing plates, they are erasable and reusable. Thus, for example, the image can be erased from the ceramic surface by thermally-activated oxidation or by laser-assisted oxidation. Accordingly, a plate can be imaged, erased and re-imaged repeatedly.

Zirconia ceramics are well-known commercially available materials which have a multitude of uses. However, their use in improving the lithographic printing process has not been heretofore disclosed and represents a major advance in the lithographic printing art.

DETAILED DESCRIPTION OF THE INVENTION

A zirconia ceramic of stoichiometric composition is hydrophilic. Transforming it from a stoichiometric composition to a substoichiometric composition changes it from hydrophilic to oleophilic. Thus, in one embodiment of this invention, the lithographic printing plate comprises a hydrophilic zirconia ceramic of stoichiometric composition and the imagewise exposure converts it to an oleophilic substoichiometric composition in the exposed regions. In an alternative embodiment of the invention, the lithographic printing plate comprises an oleophilic zirconia ceramic of substoichiometric composition and the imagewise exposure converts it to a hydrophilic stoichiometric composition in the exposed regions. In this instance, the exposed regions serve as the background or non-image areas and the unexposed regions serve as the image areas. The hydrophilic zirconia ceramic is a stable oxide, $ZrO_2$, while the oleophilic zirconia ceramic is a metastable oxide, $ZrO_{2-x}$. The change from stoichiometric to substoichiometric composition is achieved by reduction while the change from substoichiometric composition to stoichiometric composition is achieved by oxidation.

In a preferred embodiment of the invention, the lithographic printing plate is comprised of an alloy of zirconium oxide ($ZrO_2$) and a secondary oxide selected from the group consisting of MgO, CaO, $Y_2O_3$, $Sc_2O_3$, rare earth oxides, and combinations thereof. The secondary oxide can also be referred to as a dopant. The molar ratio of dopant to zirconium oxide preferably ranges from about 0.5:99.5 to about 25:75. The dopant is especially beneficial in promoting the transformation of the zirconia ceramic from the stable to the metastable state and vice versa. It also provides improved properties such as, for example, improved resistance to wear, abrasion and corrosion; higher strength; and enhanced fracture toughness.

The zirconia ceramic utilized in this inventon can be effectively converted from a hydrophilic to an oleophilic state by exposure to electromagnetic radiation with a wavelength of 1064 nanometers. Radiation of this wavelength serves to convert a stable oxide which is strongly hydrophilic to a metastable oxide which is strongly oleophilic by promoting a reduction reaction. The use for this purpose of Nd:YAG lasers that emit at 1064 nanometers is especially preferred. Conversion from an oleophilic to a hydrophilic state can be effectively achieved by exposure to electromagnetic radiation with a wavelength of 488 nanometers. Radiation of this wavelength serves to convert the metastable oleophilic oxide to the stable hydrophilic oxide by promoting an oxidation reaction. The use for this purpose of argon lasers that emit at 488 nanometers is especially preferred.

The zirconia alloys referred to hereinabove and methods for manufacturing zirconia ceramic articles having very high densities (6.03 to 6.06 grams/cc) using very fine (0.1 to 0.6 mm grain size) zirconia alloy powders are described in U.S. Pat. Nos. 5,290,332, 5,336,282 and 5,358,913, the disclosures of which are incorporated herein by reference. The resolution of laser written images on zirconia ceramic surfaces depends not only on the size of the laser spot but on the density and grain size of the zirconia. The zirconia ceramics described in the aforesaid patents are especially effective for use in lithographic printing because of their very high density and fine grain size. The printing plate can be produced by the use of conventional molding techniques (isostatic, dry pressing or injection molding) and then sintered at high temperatures, such as 1500° C., for a short period of time, such as 1 to 2 hours. Alternatively, a printing plate can be produced by thermal spray coating or vapor depositing zirconia or a zirconia alloy on a suitable flexible, semirigid or rigid substrate, such as a plastic or metallic substrate. For use in this invention, the surface of the zirconia ceramic can be thermally or mechanically polished or the zirconia ceramic can be used in the"as sintered" or"as coated" form. Preferably, the surface is polished to an average roughness of less than about 0.1 micrometers.

The zirconia ceramic utilized in this invention can be of any crystalline form including the tetragonal, monoclinic and cubic forms.

The lithographic printing plates of this invention can be imaged by any suitable technique. The essential requirement is imagewise exposure to electromagnetic radiation which is effective to convert the hydrophilic zirconia ceramic to an oleophilic state or to convert the oleophilic zirconia ceramic to a hydrophilic state. Thus, the plates can be imaged by exposure through a transparency or can be exposed from digital information such as by the use of a laser beam. Preferably, the plates are directly laser written. The laser, equipped with a suitable control system, can be used to"write the image" or to"write the background."

Zirconia ceramics of stoichiometric composition are produced when sintering is carried out in air or an oxygen atmosphere. Zirconia ceramics of substoichiometric composition are produced when sintering is carried out in an inert or reducing atmosphere.

The preferred zirconia ceramic for use in this invention is an alloy of zirconium oxide ($ZrO_2$) and yttrium oxide ($y_2O_3$) of stoichiometric composition. The preferred molar ratio of yttria to zirconia is from about 0.5:99.5 to about 5.0:95.0. Such alloys are off-white in color and strongly hydrophilic. The action of the laser beam transforms the off-white hydrophilic zirconia ceramic to black substoichiometric zirconia which is strongly oleophilic. The off-white and black compositions exhibit different surface energies, thus enabling one region to be hydrophilic and the other oleophilic. The imaging of the ceramic surface is due to photo-assisted reduction while the erasure is due to thermally-assisted reoxidation.

In preparing lithographic printing plates for use in the process of this invention by coating a zirconia ceramic layer on a support, any of a wide range of suitable support materials can be employed. Examples of preferred supports include flexible metal supports, such as supports composed of stainless steel, nickel, brass or other metals or metal alloys and flexible plastic supports such as supports composed of polyesters or cellulosic polymers. The zirconia ceramic layer deposited on the support preferably has a thickness in the range of from about 0.02 to about 5 millimeters and more preferably in the range of from about 0.1 to about 0.3 millimeters.

The zirconia ceramic layer is able to bond very strongly to the support and exhibits sufficient flexibility that the resulting printing plate can be wrapped around a conventional press cylinder without cracking or other damage.

For imaging the zirconia ceramic printing surface, it is preferred to utilize a high-intensity laser beam with an intensity at the printing surface of at least about 5000 milliwatts per square micrometer and more preferably of at least about 7000 milliwatts per square micrometer.

An especially preferred laser for use in imaging the lithographic printing plate in the method of this invention is an Nd:YAG laser that is Q-switched and optically pumped with a krypton arc lamp. The wavelength of such a laser is 1.06 mm ($1.06\times10^{-6}$ meters).

For use in the hydrophilic to oleophilic conversion process, the following parameters are characteristic of a laser system that is especially useful. Laser Power: CW average—2 to 40 watts Peak power—50 W to 5 KW (Q-switched) Current—16 to 28 A Pulse Rate: Up to 50 kHz Pulse Width: 100 to 150 ns Scan Field: 114.3 mm×114.3 mm Scan Velocity: Up to 3 meters/second Repeatability: ±25 mm The laser images can be easily erased from the zirconia surface by either heating the surface in air at an elevated temperature (temperatures of from about 100° C. to about 1500° C. for a period of about 5 to about 60 minutes are generally suitable with a temperature of about 200° C. for a period of about 10 minutes being preferred) or by treating the surface with a $CO_2$ laser operating in accordance with the following parameters: Wave length: 10.6 mm Peak Power: 300 watts (operated at 20% duty cycle) Average Power: 70 watts Beam Size: 500 mm with the beam width being pulse modulated In addition to its use as a means for erasing the image, a $C_2$ laser can be employed as a means of carrying out the imagewise exposure in the process employing an oleophilic to hydrophilic conversion.

Only the surface of the zirconia ceramic is altered in the image-forming process of this invention. However, the image formed is a permanent image which can only be removed by means such as the thermally-activated or laser-assisted oxidation described herein.

Upon completion of a printing run, the printing surface of the printing plate can be cleaned of ink in any suitable manner and then the image can be erased and the plate can be re-imaged and used again. This sequence of steps can be repeated again and again as the plate is extremely durable and long wearing.

In the working examples provided herein, the images were captured electronically with a digital flat bed scanner or a Kodak Photo CD. The captured images were converted to the appropriate dot density, in the range of from about 80 to about 250 dots/cm. These images were then reduced to two colors by dithering to half tones. A raster to vector conversion operation was then executed on the half-toned images. The converted vector files in the form of plot files were saved and were laser scanned onto the ceramic surface. The marking system accepts only vector coordinate instructions and these instructions are fed in the form of a plot file. The plot files are loaded directly into the scanner drive electronics. The electronically stored photographic images can be converted to a vector format using a number of commercially available software packages such as Corel Drive or Envision-It by Envision Solutions Technology.

The invention is further illustrated by the following examples of its practice.

EXAMPLE 1

Several off-white colored 23-mm diameter X 2.5-mm thick zirconia-yttria ceramic disks were irradiated by a Nd:YAG laser so that the entire surface area turned black. The Nd:YAG laser was Q-switched and optically pumped with a krypton arc lamp. The spot size or beam diameter was approximately 100 mm in TEM (low order mode). The spot size can be increased to 300 mm in MM (multimode) using a 163-mm focusing lens. The beam diameter can also be made as small as 5 mm by using appropriate lenses.

The optical density of the black surface depended on the laser energy and the scan speed. Contact angle measurements were made by using a Rame-Hart contact angle goniometer. The two liquids used were double deionized water (polar) and methylene iodide (non-polar). The same measurements were made on zirconia/yttria ceramic surfaces that had not been exposed with the laser. Table 1 below summarizes the contact angle results and Table 2 summarizes the calculated surface energies. In Table 2, the total surface energy is broken down into the dispersive and polar components.

TABLE 1

| Sample | Laser Current/ Frequency | Laser Scan Speed, mm/s | Water (degrees) | Methylene Iodide (degrees) | Comments |
|---|---|---|---|---|---|
| 1 | None | — | 58.9 ± 4.2 | 39.6 ± 0.9 | White surface |
| 2 | 28 A/1 kHz | 104 | 77.9 ± 5.9 | 38.7 ± 1.0 | Black surface |

TABLE 2

| Sample | Dispersive (dynes/cm) | Polar (dynes/cm) | Total Surface (dynes/cm) |
|---|---|---|---|
| 1 | 31.0 | 16.7 | 47.7 |
| 2 | 36.1 | 5.0 | 41.1 |

The above results indicate that there is a substantial difference in contact angles (surface energy) between the laser treated and untreated areas such that water will selectively adhere to the untreated areas and an oil-based printing ink will selectively adhere to the treated areas.

EXAMPLE 2

Images containing half-tones through continuous tones were imprinted on 80 mm×60 mm×1 mm thick sintered zirconia/yttria ceramic plates. The plates were imaged using an Nd: YAG laser as described in Example 1. The imaged plate was cleaned with a fountain solution made up from Mitsubishi SLM-OD fountain concentrate. The concentrate was diluted with distilled water and isopropyl alcohol. Excess fluid was wiped away using a lint-free cotton pad. An oil-based black printing ink, Itek Mega Offset Ink, was applied to the plate by means of a hand roller. The ink selectively adhered to the imaged areas only. The image was transferred to plain paper by placing the paper over the plate and applying pressure to the paper.

The novel lithographic printing plates of this invention can be of any suitable size, shape or construction as long as the printing surface is comprised of a zirconia ceramic. The zirconia ceramic can be initially in a hydrophilic form or in an oleophilic form. The zirconia ceramic printing plates serve as the key component of a novel lithographic printing system which includes, in addition to the printing plate, a laser that is capable of imaging the zirconia ceramic surface, control means for operating the laser, a supply of fountain solution, means for applying the fountain solution to the printing surface, a supply of lithographic printing ink, and means for applying the lithographic printing ink to the printing surface. Optionally, but preferably, the lithographic printing system also includes means for erasing the image from the zirconia ceramic surface.

Use of a zirconia ceramic for lithographic printing, as disclosed herein, has many advantages over conventional lithographic printing techniques now in use. Thus, for example, the process to generate the lithographic printing plate is much faster than the conventional process because several steps are eliminated. The printing plate is very durable, having great wear-and abrasion-resistance, so that it can be used over and over again. The image is stable unless exposed to high heat, such as 200° C. heat, or high energy radiation such as that from a $C_2$ laser. The printing plate can be used more than once because the image is erasable without disturbing the ceramic surface. The printing plate can be conveniently generated on the press without having to install and dismantle for each printing application.

The invention has been described in detail, with particular reference to certain preferred embodiments thereof, but it should be understood that variations and modifications can be effected within the spirit and scope of the invention.

We claim:

1. A lithographic printing plate having a flexible support and a zirconia ceramic layer that has an outer surface adapted for use in lithographic printing, said outer printing surface being comprised of a zirconia ceramic comprised of an alloy comprising $ZrO_2$ and a secondary oxide selected from the group consisting of MgO, CaO, $Y_2O_3$, $Sc_2O_3$, rare earth oxides, and combinations thereof.

2. A lithographic printing plate as claimed in claim 1, wherein said support is a flexible metal support.

3. A lithographic printing plate as claimed in claim 1, wherein said support is a flexible plastic support.

4. The lithographic printing plate of claim 1 wherein the molar ratio of said secondary oxide to said zirconia is from about 0.5:99.5 to about 25:75.

5. The lithographic printing plate of claim 1 comprised of a zirconia-yttria ceramic.

6. The lithographic printing plate of claim 5 wherein the molar ratio of yttria to zirconia is from about 0.5:99.5 to about 5.0:95.0.

7. The lithographic printing plate of claim 1 wherein said zirconia ceramic is in a hydrophilic form.

8. The lithographic printing plate of claim 1 wherein said zirconia ceramic is in an oleophilic form.

9. The lithographic printing plate of claim 1 wherein said zirconia ceramic layer has a thickness of from about 0.02 to about 5 mm.

10. The lithographic printing plate of claim 9 wherein said zirconia ceramic layer has a thickness of from about 0.1 to about 0.3 mm.

11. The lithographic printing plate of claim 1 wherein said zirconia ceramic is in the tetragonal crystalline form.

12. A lithographic printing plate having a flexible support having an imaged outer layer having an outer surface adapted for use in lithographic printing, said outer imaged surface comprising a zirconia ceramic comprised of an alloy comprising $ZrO_2$ and a secondary oxide selected from the group consisting of MgO, CaO, $Y_2O_3$, $Sc_2O_3$, rare earth oxides, and combinations thereof, having thereon an image-wise distribution of hydrophilic areas and oleophilic areas.

* * * * *